United States Patent [19]

Feldman

[11] 4,003,328

[45] Jan. 18, 1977

[54] SELF-STEERING APPARATUS FOR SAILBOATS

[76] Inventor: Daniel P. Feldman, 3677 Baseside Lane, San Diego, Calif. 92109

[22] Filed: May 12, 1975

[21] Appl. No.: 576,852

[52] U.S. Cl. ..... 114/144 R

[51] Int. Cl.[2] ..... B63H 25/00

[58] Field of Search ..... 114/144 R, 144 A, 144 C, 114/146, 162

[56] References Cited

UNITED STATES PATENTS

| | | | |
|---|---|---|---|
| 1,679,395 | 8/1928 | Bailey | 114/144 RM |
| 2,845,891 | 8/1958 | Frey | 114/144 A |
| 2,988,930 | 6/1961 | McMurray et al. | 114/144 A |
| 3,417,723 | 12/1968 | Akermanis | 114/144 RM |

*Primary Examiner*—Trygve M. Blix
*Assistant Examiner*—Stuart M. Goldstein

[57] ABSTRACT

A self-steering mechanism comprises a pair of tension lines connected to an after section of the tiller, the lines having an elastic portion and passing through gunwale-mounted pulleys to return to a pulley and cleat assembly on the forward part of the tiller, the lines being tension-adjustable on the cleats for different points of sail and being capable of holding a boat on course without constant attention by the skipper.

7 Claims, 5 Drawing Figures

SELF-STEERING APPARATUS FOR SAILBOATS

BACKGROUND OF THE INVENTION

The invention is in the field of automatic or self-steering assemblies used on cruising sailboats.

The search for a simple self-steering device for sailboats undoubtedly antedated Joshua Slocum's historic solo circumnavigation of the globe, during which he was able to continue on course while resting by the simple expedient of lashing the wheel. This was possible because of the unusual characteristics of the sloop "Spray." Unfortunately, as is well known by sailors, most sailboats do not exhibit such stability and quickly drift off course without an alert helmsman. Because of the near necessity during solo crossings and the like that the boat be capable of holding its course unattended, numberous self-steering systems have been developed, but characteristically these systems are elaborate, expensive, and require either a wind vane, a sail angle sensing line, or both, to operate.

SUMMARY OF THE INVENTION

The present invention dispenses with the wind vane and is completely independent of the boom and rigging, is inexpensive, and under normal sailing conditions will hold most types of sailboats within about three degrees of any selected course. Two lines are used which terminate in lengths of elastic attached to an after portion of the tiller, the lines passing through pulleys on the opposite sides of the boat and being secured by pulley and cleat assemblies on a forward portion of the tiller. In use, after the boat is brought to the desired point of sail, the lines are adjusted on the cleats to provide the correct tension, and the boat will automatically tend to correct itself when moderate wind changes or wave action is encountered. The elastic portions of the lines may each include two elastic bands of different strength, the stronger being slightly slack so that the tension on the tiller is non-linear, this arrangement being advantageous in heavy seas. The elastics should be releasibly connected to the tiller so that either or both may be used at a given time, and the system is clearly very easily overrideable by the helmsman.

DETAILED DESCRIPTION OF THE PREFERRED EMBODIMENT

Figure 1:
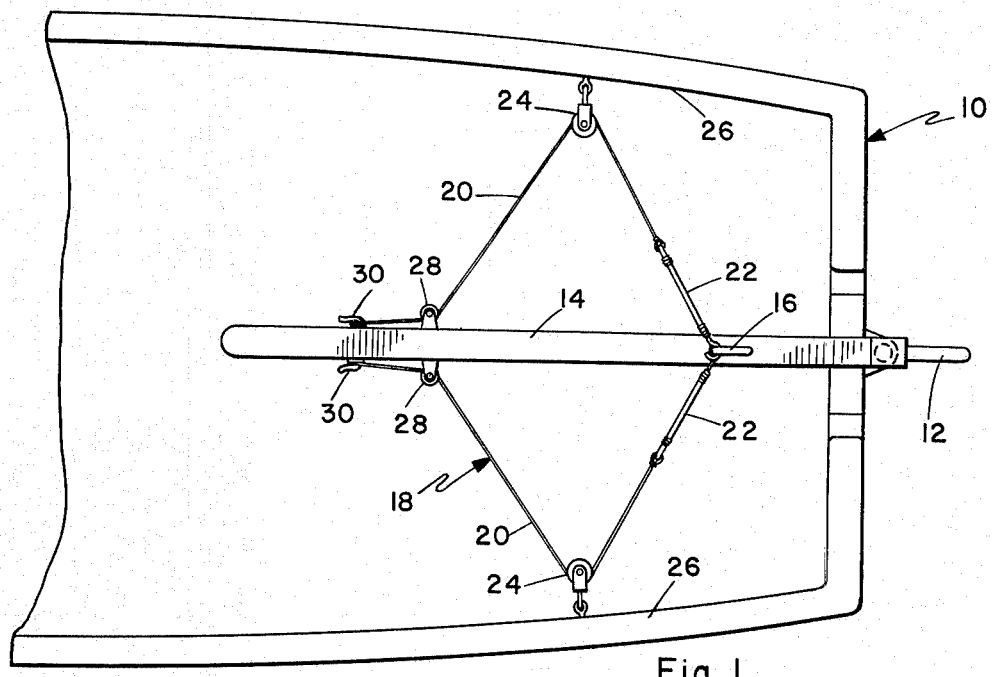
FIG. 1 is a top plan view of a portion of a sailboat showing the invention installed therein.
Figure 2:
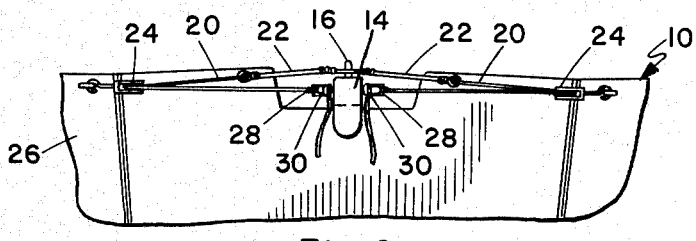
FIG. 2 is a view of the self-steering apparatus installed in a sailboat, as seen from within the boat forward of the tiller and looking aft.

A sailboat on which the apparatus is used is shown at 10, with a rudder 12 operated by the tiller 14. On a rear part of the tiller is an eyebolt 16 or an equivalent attachment means, and attached to the eyebolt are a pair of lines each of which constitutes a length of rope 20 and a connecting elastic member 22 which is preferably a length of solid rubber. The elastic could be releasible from the eyebolt as shown, but releasability is not required. In another possible variation, the two elastics could be the respective halves of a single, long elastic which is centrally clamped to the tiller.

A pair of pulleys 24 are preferably releasably swivel-mounted to portions of the boat on opposite sides of the tiller such as the gunwales 26, and the lines are threaded through these pulleys and return to a forward section of the tiller where they pass through a second set of pulleys 28 and are cinched off on the cleats 30. Clearly the lines are independently adjustable in effective length and tension to accomodate prescribed sail settings.

Figure 5:
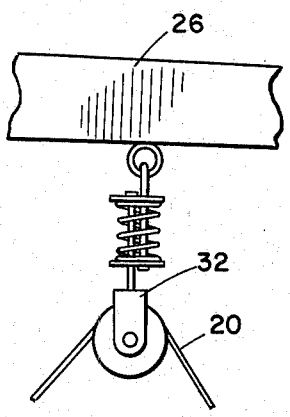
FIG. 5 is a top plan view of a modified spring loaded pulley installed in the gunwale.
Figure 3:
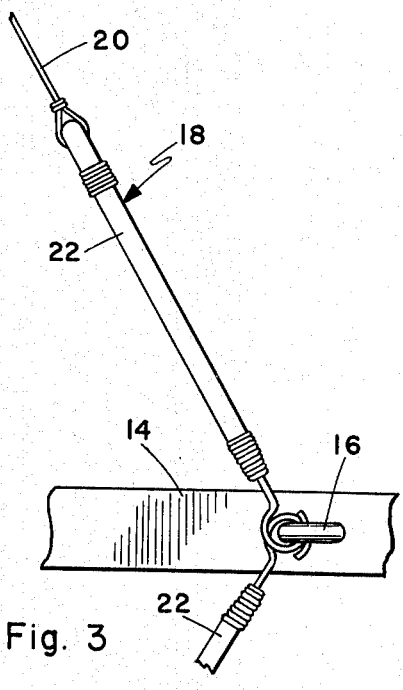
FIG. 3 is a plan view of a detail of the tiller showing the eyebolt and the connecting elastics.

The invention as thus described can be set to hold the boat on any course desired, although exactly why this is true is not completely known. However, approximately the same results could be obtained by using a pair of spring-loaded pulleys similar to that illustrated at 32 in FIG. 5 in place of the pulleys 24, either without or in concert with the elastic sections in the lines. Also, the spring loaded pulleys 32 could be replaced by tension spring assemblies exhibiting the proper tensile characteristic and having only one length of line connected to the tiller from each side of the boat, although the arrangement shown is simpler.

Figure 4:
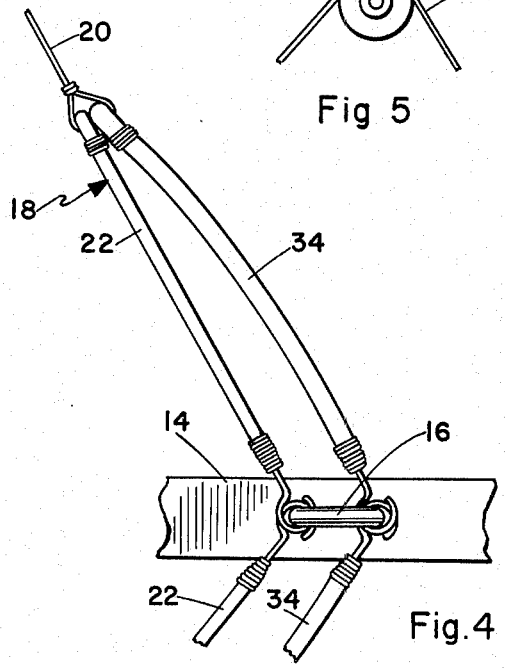
FIG. 4 is a plan view similar to FIG. 3 but showing a double elastic modification.

FIG. 4 displays a slight variation in which an additional elastic band 34 of greater strength than the bands 22 is added to each line. The stronger bands are slightly longer than the others so that they only come into play after the weaker bands are tensioned, so that the lines have a non-linear stretching characteristic. The heavy duty bands are releasibly connected to the tiller eyebolt so that either or both of the bands may be used, depending on the condition of the weather and seas.

If the boat on which the self-steering apparatus is used is large, it might be necessary to incorporate block and tackle assemblies in both lines. Other variations in the mechanical details of the system, such as the exact location and nature of fastening means such as the eyebolt, cleats, and pulleys and the connection thereto, are intended to fall within the scope of the invention as defined by the claims.

I claim:

1. In a sailboat having, an elongated tiller bar connected to a rudder and pivoted at the aftermost end thereof and extending substantially forward therefrom, a self-steering mechanism comprising:

a. sheave means comprising a pair of sheaves mounted respectively on opposite sides of said sailboat in an area thereof generally laterally aligned with said tiller;

b. line means comprising a pair of length-adjustable lines each:

i. having an aft end attached to an aft portion of said tiller and ii. passing forwardly through a respective one of said sheaves, and iii. having a forward end attached to a forward portion of said tiller such that each of said line means together with the portion of the tiller between the points of attachment of said line means substantially define a triangle forward of the pivot point of said tiller;

c. one of said means being resilient to permit said tiller to move when said lines are taut whereby upon water pressure being exerted upon said rudder and said tiller responding thereto a resistance to tiller movement is achieved by the shifting of said line means through said sheaves and the resultant shifting of the triangle defined by said line means and said tiller.

2. Structure according to claim 1 wherein said sheaves are spring-loaded pulleys and comprise said resilient means.

3. Structure according to claim 1 wherein a portion of each of said lines comprise a length of elastic cord.

4. Structure according to claim 3 wherein said elastic lengths comprise one end portion of each of the respective lines and said elastic lengths are releasibly attached to the tiller, each of said lines having a second length of elastic of different strength than the other elastic length joined thereto and having means to releasibly engage said tiller, whereby either one, or both, of said lines may be alternatively connected to the tiller.

5. Structure according to claim 4 wherein the stronger ones of said elastics are longer than the weaker elastics, all of said elastics being connected to the same general location on the tiller.

6. Structure according to claim 1 wherein one end of each of said lines is connected to longitudinally spaced portions of said tiller, and including a pair on conventional quick release cleats mounted near the forward end of said tiller to adjustably engage said lines.

7. Structure according to claim 6 and including a pair of pulleys mounted on said tiller adjacent respective ones of said cleats, said lines being threaded through said pulleys and engaged on said cleats.

* * * * *